US009390671B2

(12) United States Patent
Min et al.

(10) Patent No.: US 9,390,671 B2
(45) Date of Patent: Jul. 12, 2016

(54) LIQUID CRYSTAL DISPLAY DEVICE AND DRIVING METHOD THEREOF

(71) Applicant: LG Display Co., Ltd., Seoul (KR)

(72) Inventors: Woong Ki Min, Paju-si (KR); Hong Sung Song, Goyang-si (KR); Dong Kyoung Oh, Gumi-si (KR); Yong Ki Son, Paju-si (KR); Su Hyuk Jang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 118 days.

(21) Appl. No.: 13/724,161

(22) Filed: Dec. 21, 2012

(65) Prior Publication Data

US 2013/0314393 A1 Nov. 28, 2013

(30) Foreign Application Priority Data

May 25, 2012 (KR) ..... 10-2012-0055731

(51) Int. Cl.
*G09G 3/36* (2006.01)

(52) U.S. Cl.
CPC ..... *G09G 3/3655* (2013.01); *G09G 3/36* (2013.01); *G09G 3/3648* (2013.01); *G09G 3/3696* (2013.01); *G09G 2320/0209* (2013.01); *G09G 2320/0242* (2013.01); *G09G 2320/0247* (2013.01); *G09G 2320/04* (2013.01)

(58) Field of Classification Search
CPC ..... G09G 3/36; G09G 3/3648; G09G 3/3655; G09G 3/3696; G09G 2300/043; G09G 2320/0209; G09G 2320/0242; G09G 2320/0247; G09G 2320/0271; G09G 2320/04; G09G 2320/043; G09G 2320/045
See application file for complete search history.

(56) References Cited

U.S. PATENT DOCUMENTS

2004/0022652 A1 2/2004 Miura et al.
2005/0156840 A1 * 7/2005 Kim et al. ..... 345/87

(Continued)

FOREIGN PATENT DOCUMENTS

CN 1854823 A 11/2006
CN 101344657 A 1/2009

(Continued)

OTHER PUBLICATIONS

Korean Intellectual Property Office, Office Action, Korean Patent Application No. KR 10-2012-0055731, Aug. 28, 2013, four pages. (Claims 1-3 and 13 of KR 10-2012-0055731 were rejected as lacking an inventive step in view of KR 10-2008-0062481 and KR 10-2008-0107778; claims 4-12 and 14-15of KR 10-2012-0055731 were indicated as allowable).

(Continued)

*Primary Examiner* — David Tung
(74) *Attorney, Agent, or Firm* — Fenwick & West LLP

(57) ABSTRACT

Disclosed is a liquid crystal display panel configured to include at least one common electrode bar and a plurality of divisional areas defined along a length direction of the at least one common electrode bar; a common voltage controller configured to divide a single frame into a plurality of intervals corresponding to the plurality of divisional areas and generate a common voltage control signal in each interval; and a common voltage compensator configured to generate a compensated common voltage on the basis of the common voltage control signal in each interval and apply the compensated common voltage to the at least one common electrode bar of the liquid crystal display panel.

10 Claims, 9 Drawing Sheets

(56) References Cited

U.S. PATENT DOCUMENTS

| | | | | |
|---|---|---|---|---|
| 2006/0244704 | A1* | 11/2006 | JaeHun | 345/92 |
| 2007/0002005 | A1* | 1/2007 | Kim et al. | 345/103 |
| 2009/0015528 | A1 | 1/2009 | Sheu et al. | |
| 2009/0102991 | A1 | 4/2009 | Chen et al. | |
| 2009/0284456 | A1* | 11/2009 | Song et al. | 345/94 |
| 2012/0162184 | A1* | 6/2012 | Kim | G09G 3/3655 345/212 |

FOREIGN PATENT DOCUMENTS

| | | | |
|---|---|---|---|
| CN | 101587692 | A | 11/2009 |
| KR | 10-2007-0116408 | A | 12/2007 |
| KR | 20070116408 | A * | 12/2007 |
| KR | 10-2008-0062481 | A | 7/2008 |
| KR | 10-2008-0107778 | A | 12/2008 |
| KR | 10-2010-0063170 | A | 6/2010 |
| TW | 200918994 | A | 5/2009 |

OTHER PUBLICATIONS

Taiwan Office Action, Taiwan Application No. 101149352, Nov. 7, 2014, 13 pages.

State Intellectual Property Office of the People's Republic of China, Office Action, Chinese Patent Application No. 201210579339.2, Jan. 30, 2015, thirteen pages [with concise explanation of relevance in English.].

* cited by examiner

LIQUID CRYSTAL DISPLAY DEVICE AND DRIVING METHOD THEREOF

The present application claims priority under 35 U.S.C. §119(a) to Republic of Korea Patent Application No. 10-2012-0055731 filed on May 25, 2012, which is hereby incorporated by reference in its entirety.

BACKGROUND

The present application relates to a liquid crystal display device.

Also, the present application relates to a method of driving a liquid crystal display device.

Recently, a variety of display devices are being developed. The display devices include liquid crystal display devices, plasma display devices, organic light-emitting display devices, field emission display devices, and so on.

Among these display devices, liquid crystal display devices have the features of high definition, high image quality, high contrast, lower power consumption, reality of full-color motion image and so on. As such, the liquid crystal display devices are considered to be the main current of display devices.

The liquid crystal display device includes a liquid crystal display panel for displaying images. A common electrode bar receiving a common voltage is disposed on the liquid crystal display panel. The common voltage is used as a reference voltage.

In accordance therewith, if the common voltage is applied to one end of the common electrode bar, a delay of the common voltage is caused by resistance and capacitance components of the common electrode bar as it goes from one end of the common electrode bar to the other end.

Moreover, the common electrode bar is disposed in such a manner as to cross a data line used to transfer a data voltage. As such, a ripple must be generated in the common voltage applied to the common electrode bar due to the data voltage. The ripple is a distortion component of a signal. Such a ripple enables difference between the data voltage and the common voltage to be non-uniformed. Therefore, error in the brightness can be generated.

SUMMARY

Accordingly, embodiments are directed to a liquid crystal display device that substantially obviates one or more of problems due to the limitations and disadvantages of the related art, and a method of driving the same.

The embodiments are to provide a liquid crystal display device that is adapted to uniformly maintain a common voltage in the entire region of a common electrode bar.

Also, the embodiments are to provide a liquid crystal display device that is adapted to prevent error in brightness by compensating for the ripple of a common voltage.

Moreover, the embodiments are to provide a method of driving the above-mentioned liquid crystal display device.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a first general aspect of the present embodiment, a liquid crystal display device includes: a liquid crystal display panel configured to include at least one common electrode bar and a plurality of divisional areas that are defined along a length direction of the at least one common electrode bar; a common voltage controller configured to divide a single frame into a plurality of intervals corresponding to the plurality of divisional areas and generate a common voltage control signal in each interval; and a common voltage compensator configured to generate a compensated common voltage on the basis of the common voltage control signal in each interval and apply the compensated common voltage to the at least one common electrode bar of the liquid crystal display panel.

A method of driving a liquid crystal display device, which includes a liquid crystal display panel configured to include at least one common electrode bar and a plurality of divisional areas defined along a length direction of the at least one common electrode bar, according to a second general aspect of the present embodiment includes: setting a number of divisional areas to be defined along a length direction of the at least one common electrode bar; dividing a single frame into a plurality of interval corresponding to the number of the plurality of divisional areas and generating a common voltage control signal in accordance with each interval; and generating a compensated common voltage to be applied to the at least one common electrode bar based on the common voltage control signal in each interval.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated herein and constitute a part of this application, illustrate embodiment(s) of the present disclosure and together with the description serve to explain the disclosure. In the drawings.

DETAILED DESCRIPTION OF THE EMBODIMENTS

Figure 1:
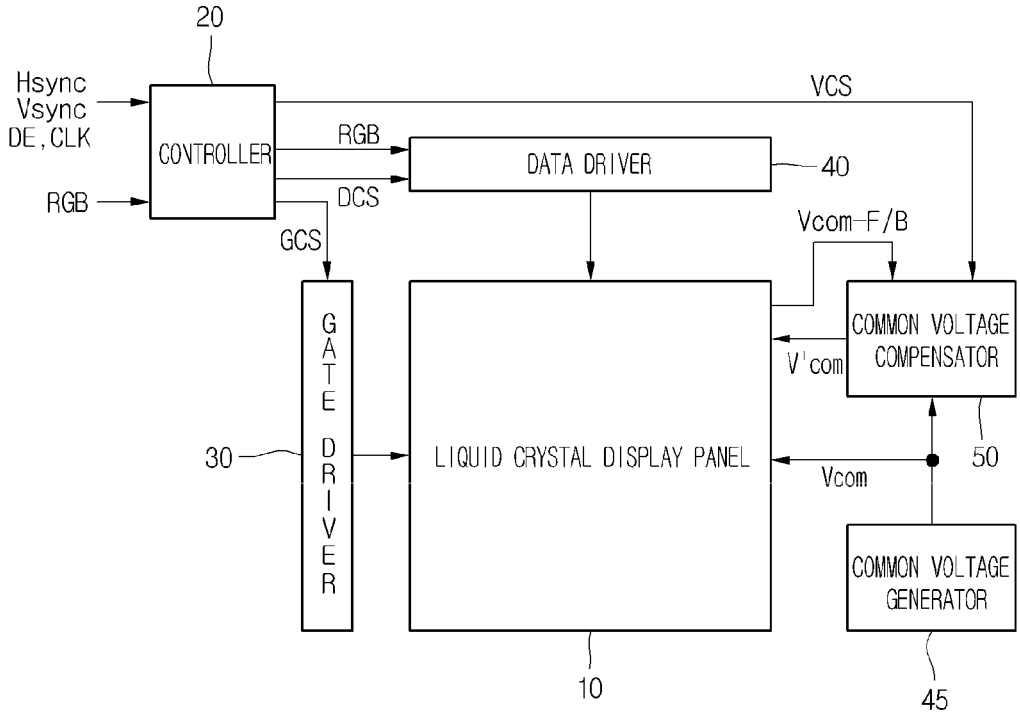
FIG. 1 is a block diagram showing a liquid crystal display device according to an embodiment of the present disclosure.

In the present disclosure, it will be understood that when an element, such as a substrate, a layer, a region, a film, or an electrode, is referred to as being formed "on" or "under" another element in the embodiments, it may be directly on or under the other element, or intervening elements (indirectly) may be present. The term "on" or "under" of an element will be determined based on the drawings.

Reference will now be made in detail to the present embodiments, examples of which are illustrated in the accompanying drawings. In the drawings, the sizes and thicknesses of elements can be exaggerated, omitted or simplified for clarity and convenience of explanation, but they do not mean the practical sizes of elements.

FIG. 1 is a block diagram showing a liquid crystal display device according to an embodiment of the present disclosure.

Referring to FIG. 1, the liquid crystal display device according to an embodiment of the present disclosure can include a liquid crystal display panel 10, a gate driver 30, a data driver 40, a controller 20, a common voltage generator 45 and a common voltage compensator 50.

For example, the liquid crystal display panel 10 can receive a common voltage generated from the common voltage generator 45 only at its initial driving time, and a compensated common voltage generated from the common voltage compensator 50 after the initial driving time. However, the present embodiment is not limited to this.

Alternatively, the liquid crystal display panel 10 can receive the common voltage generated from the common voltage generator 45 only at a start time of each frame, i.e., only when a gate signal is applied to a first gate line. Also, the liquid crystal display panel 10 can receive the compensated common voltage generated from the common voltage compensator 50 during the remaining period of the frame. However, the present embodiment is not limited to this.

The liquid crystal display panel 10 can display images. In order to display an image on the liquid crystal display panel 10, a pixel or a pixel row for displaying the image can be selected by the gate driver 30. Also, the data driver 40 can apply a data voltage to the selected pixel or the selected pixel row. Moreover, the common voltage from the common voltage generator 45 or the compensated common voltage from the common voltage compensator 50 can be applied to the selected pixel or the selected pixel row.

The gate driver 30, the data driver 40, the common voltage generator 45 and the common voltage compensator 50 can be driven under the control of the controller 20. In other words, the controller 20 can control not only these components but also all other components which are included in the liquid crystal display device and perform optional functions.

The controller 20 controlling these components can control images and display timings of images.

The gate driver 30 can generates the gate signal used to select the pixel or the pixel region on the liquid crystal display panel 10 under the control of the controller 20.

The data driver 40 can apply the data voltage to the selected pixel or the selected pixel row under the control of the controller 20.

For example, the controller 20 can generate gate control signals GCS and data control signals DCS, but it is not limited to this. The gate control signals GCS can be used to control the gate driver 30 and the data control signals DCS can be used to control the data driver 40.

The gate control signals GCS can at least include a gate start signal VST which starts the gate driver 30 in order to apply the gate signal to the first gate line on the liquid crystal display panel 10.

Figure 2:
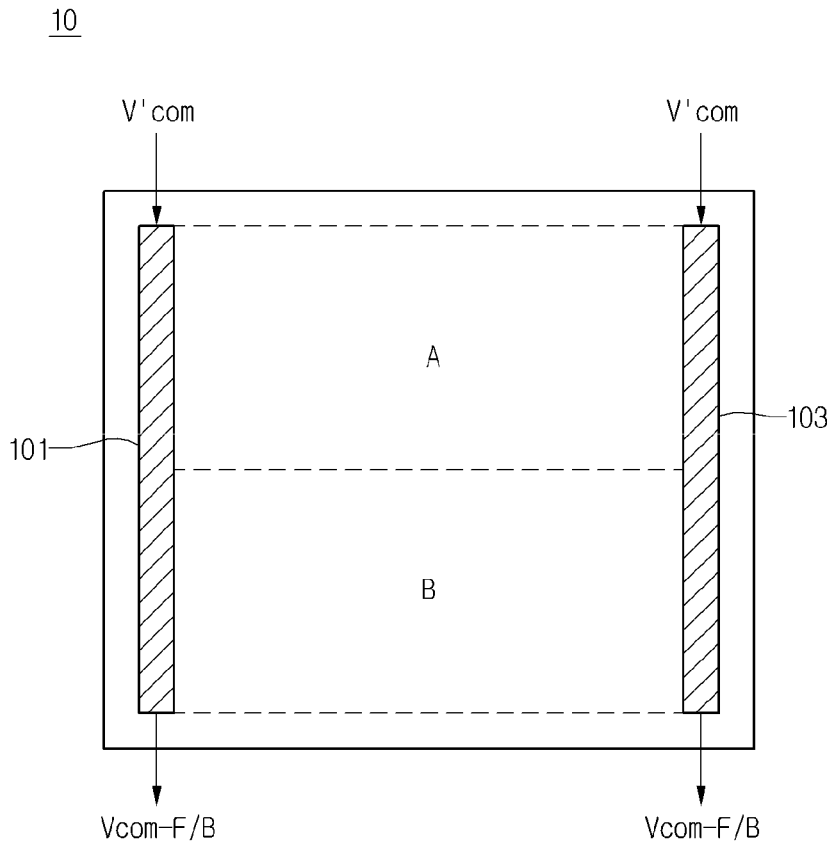
FIG. 2 is a planar view showing the liquid crystal display panel of FIG. 1 which is divided into two divisional areas.

The liquid crystal display panel 10 can include at least one common electrode bar disposed on at least one edge thereof. For example, a first common electrode bar 101 can be disposed on a first edge of the liquid crystal display panel 10 and a second common electrode bar 103 can be disposed on a second edge of the liquid crystal display panel 10, as shown in FIG. 2. However, the present embodiment is not limited to such configuration.

As another example, the common electrode bar can be formed along edges of the liquid crystal display panel 10 in a closed loop shape.

As still another example, the common electrode bars can be disposed on left, right, top and/or bottom edges in such a manner as to be separated from one another.

The above-mentioned common electrode bars 101 and 103 can be disposed on a non-display area. A display area includes a plurality of pixels, and the non-display area is defined by the area around the display area.

The liquid crystal display panel 10 can includes the display area and the non-display area, but it is not limited to this. The display area is used to display images. The non-display area does not display any image. A variety of signal lines, circuit chips and so on which are necessary to display images can be loaded on the non-display area.

For convenience of explanation, the description of the present embodiment will be focused on the first and second common electrode bars 101 and 103 shown in FIG. 2.

The liquid crystal display panel 10 can be defined into first and second divisional areas A and B, as shown in FIG. 2. The first and second divisional area A and B can each receive differently compensated common voltages.

The first and second divisional areas A and B can be defined along the length direction of the first and second electrode bars 101 and 103.

For example, the first divisional area A can be defined as the first half display area between the upper half portion of the first common electrode bar 101 and the upper half portion of the second common electrode bar 103. The second divisional area B can be defined as the second half display area between the lower half portion of the first common electrode bar 101 and the lower half portion of the second common electrode bar 103.

If a first compensated common voltage is applied to the first divisional area A, a second compensated common voltage higher than the first compensated common voltage can be applied to the second divisional area B, as an example. The first and second compensated common voltages can be generated in the common voltage compensator 50. The first and second compensated voltages will be described in detail later.

Figure 3:
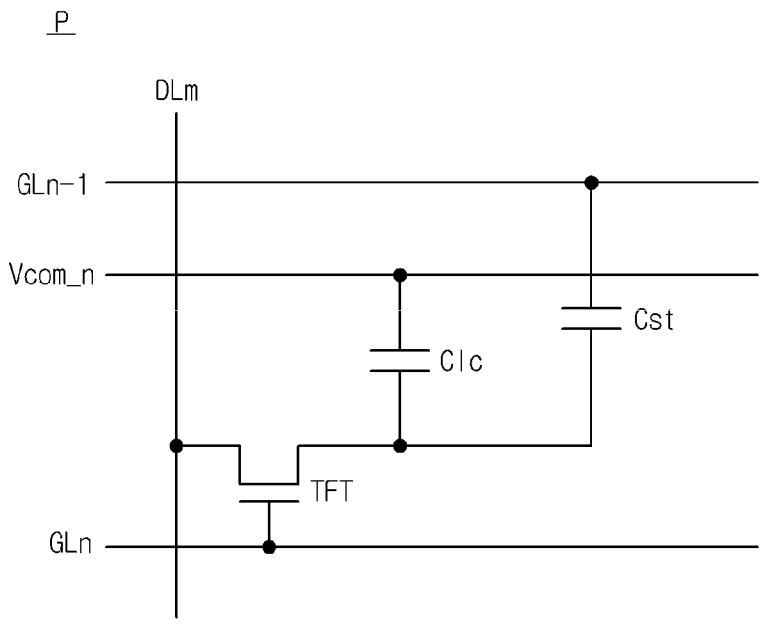
FIG. 3 is a circuit diagram showing a unit pixel formed on the liquid crystal display panel of FIG. 2.

As shown in FIG. 3, a plurality of signal lines and a plurality of elements are arranged on the liquid crystal display panel 10.

A plurality of gate lines GLn can be formed by extending along a first direction. A plurality of data line DLm can be formed by extending along a second direction crossing the gate lines GLn.

Also, a plurality of common electrode lines Vcom_n can be formed by extending along the first direction parallel to the gate lines GLn, but it is not limited to such configuration.

For example, the first direction can be a horizontal direction and the second direction can be a vertical direction, but it is not limited to such configuration either.

The plurality of common electrode lines Vcom_n can be electrically connected to the first and second common electrode bars 101 and 103 shown in FIG. 2.

More specifically, one end of the common electrode line Vcom_n can be electrically connected to the first common electrode bar 101 and the other end of the common electrode line Vcom_n can be electrically connected to the second electrode bar 103.

The first and second common electrode bars 101 and 103 can be formed by extending along the second direction parallel to the data line DLm. In this case, the first and second common electrode bars 101 and 103 cross the gate line GLn. As such, the first and second common electrode bars 101 and 103 and the gate line GLn can be disposed in different layers from each other, in order to prevent an electrical short circuit. For example, the first and second common electrode bars 101 and 103 can be disposed in the same layer as the data line or a pixel electrode which will be explained later, but it is not limited to such configuration.

The common electrode line Vcom_n can be disposed in the same layer as the gate line GLn. Alternatively, the common electrode line Vcom_n can be disposed in the same layer as one of the data line DLm and the pixel electrode. However, the common electrode line Vcom_n is not limited to this.

The gate line GLn and the data line DLm crossing each other can define a pixel region P. As such, a plurality of pixel regions P arranged on the liquid crystal display panel 10 in a matrix shape can be defined by the gate lines GLn and the data lines DLm crossing each other. However, the present embodiment is not limited to such arrangement of the pixel regions P.

The pixel region P can include a thin film transistor TFT, a liquid crystal cell Clc, a storage capacitor Cst and so on, but it is not limited to such configuration.

The thin film transistor TFT can include a gate electrode, a semiconductor layer, a source electrode and a drain electrode. The semiconductor layer can include an active layer and an ohmic contact layer, but it is not limited to such configuration.

The gate electrode can be formed by protruding from the gate line GLn. If necessary, the thin film transistor TFT can be formed on the gate line GLn. In this case, the gate line GLn can be used as a gate electrode, but it is not limited to such configuration.

The semiconductor layer has the function of applying or intercepting the data voltage. The source electrode and the drain electrode can be disposed on the semiconductor layer in such a manner as to be separated from each other. A state of the semiconductor layer allowing the data voltage to be transferred can be called as an active state, and another state of the semiconductor layer shielding the supply of the data voltage can be called as an inactive state.

The active and inactive states of the semiconductor layer can be controlled by the gate signal applied to the gate electrode.

For example, if the semiconductor layer becomes the active state by the gate signal applied to the gate electrode, the data voltage can be transferred from the source electrode to the drain electrode through the semiconductor layer.

On the contrary, when the semiconductor layer becomes in the inactive state by the gate signal applied to the gate electrode, the data voltage cannot pass through the semiconductor layer. As such, the data voltage cannot be transferred to the drain electrode.

The source electrode can be formed by protruding from the data line DLm. The drain electrode can be electrically connected to the pixel electrode. As such, the data voltage supplied to the drain electrode by the activated semiconductor layer can be applied to the pixel electrode.

The liquid crystal cell Clc corresponds to a capacitor formed by a liquid crystal material which is included in the liquid crystal display panel 10. Such a capacitor can be driven by a potential difference between the data voltage applied to the pixel electrode and the common voltage applied to the common electrode line Vcom_n.

For example, in an IPS (In-Plane Switching) mode liquid crystal display panel, a plurality of pixel electrode patterns extended from a pixel electrode and a plurality of common electrode patterns extended from the common electrode line can be arranged alternately with each other. In this case, the liquid crystal cell Clc can be driven by a potential difference between the data voltage applied to the pixel electrode patterns and the common voltage applied to the common electrode patterns. The potential difference enables liquid crystal molecules to be displaced, and then the displacement of the liquid crystal molecules can control the quantity of transmitted light.

The storage capacitor Cst can be formed by the overlap of the pixel electrode and a previous gate line GLn-1. In other words, a potential difference between a gate signal with a low level applied to the previous gate line GLn-1 and the data voltage applied to the pixel electrode can be maintained for a fixed period, for example, for a single frame by means of a dielectric material, such as a gate insulation layer, disposed between the pixel electrode and the previous gate line GLn-1.

Figure 4:
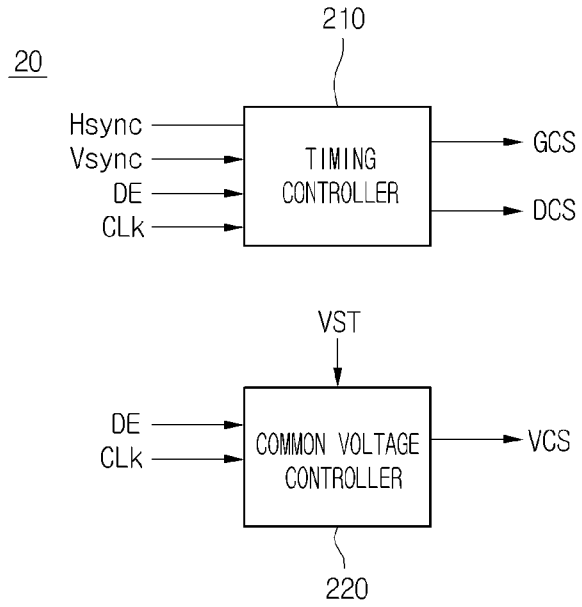
FIG. 4 is a detailed block diagram showing the controller of FIG. 1.

FIG. 4 is a detailed block diagram showing the controller of FIG. 1.

Referring to FIG. 4, the controller 20 can include a timing controller 210 and a common voltage controller 220.

The timing controller 210 can generate control signal and other signals which are necessary to display images on the liquid crystal display panel 10.

For example, the timing controller 210 can receive a vertical synchronous signal Vsync, a horizontal synchronous signal Hsync, a data enable signal DE and a clock signal CLK from an external circuit such as a video card. The timing controller 210 can derive the gate control signals GCS, which are used to control the gate driver 30, and the data control signals DCS, which are used to control the data driver 40, from the received signals. The timing controller 210 can further generate a polarity control signal POL (not shown) used to drive the liquid crystal display panel 10 in an inversion mode, but it is not limited to this.

The gate control signals GCS can at least include a gate start signal VST which is used to start the gate driver 30 in order to apply the gate signal to the first gate line of the liquid crystal display panel 10. Also, the gate control signals GCS can include a gate shift signal GSS and a gate output control signal GOE, but it is not limited to this. The gate shift signal GSS is used to shift the gate signal by a single horizontal interval and enable the shifted gate signal to be applied to the next gate line. The gate output control signal GOE is used to control the output of the gate signal.

The common voltage controller 220 can receive the data enable signal, the clock signal CLK and the gate start signal VST included in the gate control signals GCS which are output from the timing controller 210. As such, the common voltage controller 220 can count the number of pulses included in the data enable signal DE and generate a common voltage control signal in accordance with the counted value.

Meanwhile, the common voltage controller 220 is not included in the controller 20. In other words, the common voltage controller 220 can be configured in such a manner as to be separated from the controller 20. However, the common voltage controller is not limited to this.

Figure 5:
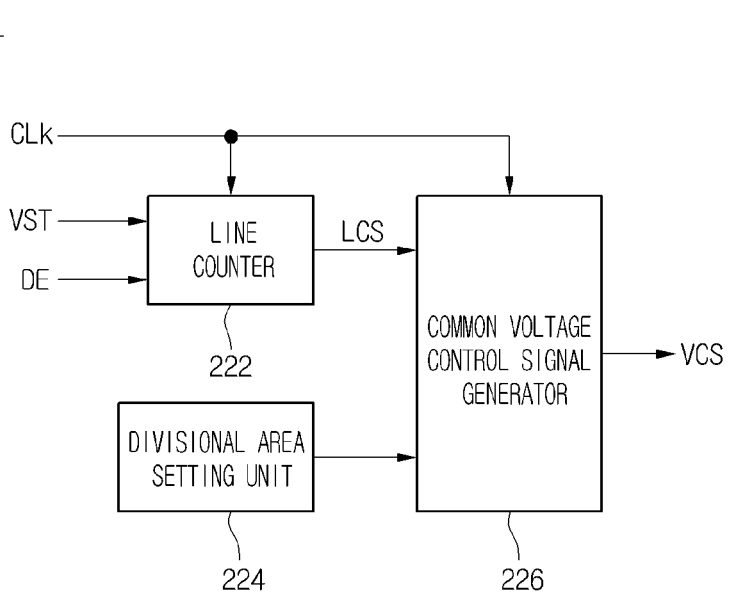
FIG. 5 is a detailed block diagram showing the common voltage controller of FIG. 4.

The common voltage controller 220 can include a line counter 222 and a common voltage control signal generator 226, as shown in FIG. 5.

The common voltage controller 220 can further include a divisional area SETTING UNIT 224 configured to set a parameter (an address signal) for the number of divisional areas to which differently compensated common voltages from one another are applied.

For example, if the liquid crystal display panel 10 is defined into the two divisional areas as shown in FIG. 2, the divisional area SETTING UNIT 224 can supply the common voltage control signal generator 226 with the parameter (the address signal) regarding the two divisional areas. As such, the common voltage control signal generator 226 can divide a single frame into first and second intervals on the basis of the parameter (the address signal) regarding the two divisional areas. Also, the common voltage control signal generator 226 can generate the common voltage control signal which is used to control the differently compensated common voltages to be generated in the first and second intervals.

Figure 8:
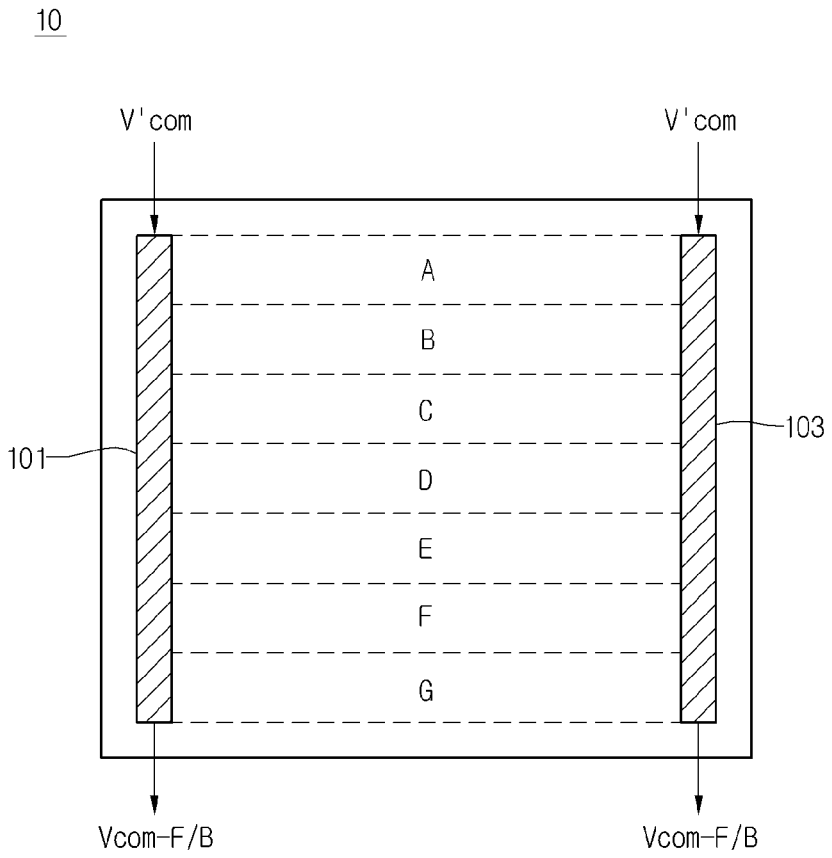
FIG. 8 is a planar view showing the liquid crystal display panel of FIG. 1 which is divided into seven divisional areas.

As another example, when the liquid crystal display panel 10 is defined into seven divisional areas as shown in FIG. 8, the divisional area SETTING UNIT 224 can supply the common voltage control signal generator 226 with the parameter (the address signal) regarding the seven divisional areas. As such, the common voltage control signal generator 226 can divide a single frame into first through seventh intervals on the basis of the parameter (the address signal) regarding the seven divisional areas. Also, the common voltage control signal generator 226 can generate the common voltage control signal which is used to control the differently compensated common voltages to be generated in the first through seventh intervals.

In other words, the differently compensated common voltages corresponding to the number of divisional areas can be generated on the basis of the parameter (the address signal), which indicate the number of divisional areas and are applied from the divisional area SETTING UNIT 224 to the common voltage control signal generator 226, and can be supplied to the liquid crystal display panel 10 in each of the plurality of intervals into which a single frame is time-divided according to the number of divisional areas.

For example, if the parameter (the address signal) regarding the two divisional areas is applied from the divisional area SETTING UNIT 224 to the common voltage control signal generator 226, a first compensated common voltage generated in a first interval under the control of the common voltage control signal can be supplied to the first and second common electrode bars 101 and 103 of the liquid crystal display panel 10. As such, the first compensated common voltage can be applied to the common electrode lines Vcom_n arranged between the first and second common electrode bars 101 and 103 within the first divisional area A. As an example, if fifty gate lines are arranged within the first divisional area A, fifty common electrode lines are arranged within the first divisional area A in the same number as the gate lines. Therefore, the first compensated common voltage can be applied to the fifty common electrode lines.

During a second interval following the first interval, a second compensated common voltage can be generated under the control of the common voltage control signal and supplied to the first and second common electrode bars 101 and 103 of the liquid crystal display panel 10. Also, the compensated common voltage can be applied to the common electrode lines Vcom_n which are arranged between the first and second common electrode bars 101 and 103 within the second divisional area B.

The line counter 222 can count the number of pulses of the data enable signal DE. Also, the line counter 222 can apply the counted value to the common voltage control signal generator 226 as a line count signal LCS.

Figure 6:
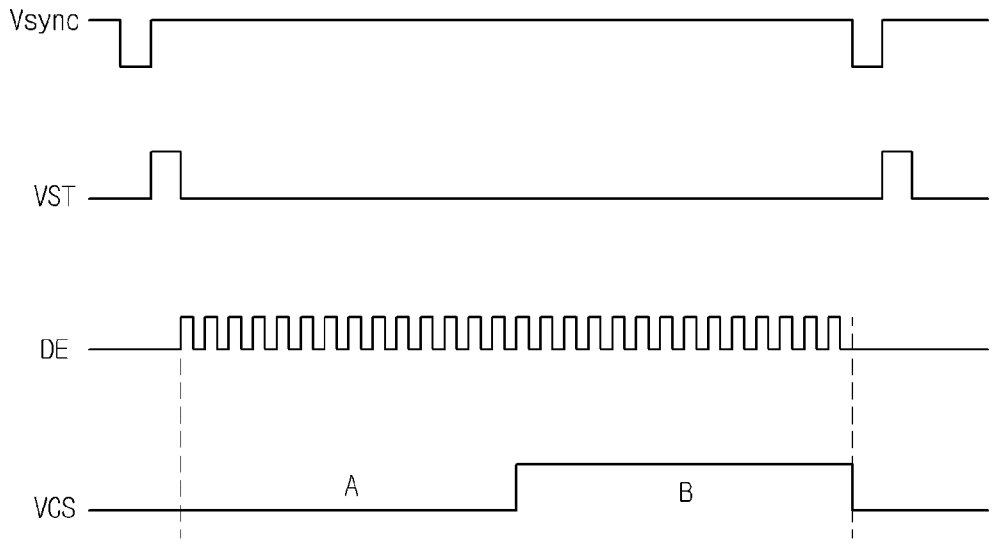
FIG. 6 is a waveform diagram illustrating input and output signals of the common voltage controller of FIG. 5.

As shown in FIG. 6, a single frame can be defined by a blank interval (the period of a low level pulse) of the vertical synchronous signal Vsync.

The gate start signal VST included in the gate control signals GCS is used to indicate the start time of a single frame. Also, the gate start signal VST can be used to start the gate driver 30 in order to apply the gate signal to the first gate line of the liquid crystal display panel 10. However, the gate start signal VST is not limited to these.

The gate start signal VST can include a high level pulse generated at an adjacent time point to and following the blank interval of the vertical synchronous signal Vsync. As such, the gate start signal VST with the high level pulse can enable the gate signal to be generated in the gate driver 30 and applied to the first gate line of the liquid crystal display panel 10.

Also, the gate shift signal GSS included in the gate control signals GCS can enable the gate signal to be sequentially shift-generated in a single horizontal interval and applied to the second through the last gate lines of the liquid crystal display panel 10.

The thin film transistor TFT of each pixel region P connected to the respective gate line GLn can be turned-on by the above-mentioned gate signal. As such, the data voltage can be applied from the respective data line DLm to the pixel electrode or the pixel electrode patterns via the turned-on thin film transistor TFT.

The data enable signal DE can be a signal indicating the number of pixel data which can be applied during a single frame, but it is not limited to this.

The line counter 222 can count the number of pulses of the data enable signal DE based on the high level pulse of the gate start signal VST.

The common voltage control signal generator 226 can recognize the number of divisional areas defined on the liquid crystal display panel 10 on the basis of the parameter (the address signal) applied from the divisional area SETTING UNIT 225.

The common voltage control signal generator 226 can divide the total number of pulses of the data enable signal DE, which are included in the single frame, by the recognized number of divisional areas and can define a single frame into a plurality of intervals.

For example, if the total number of pulses of the data enable signal DE included is 28 and the liquid crystal display panel 10 is defined into two divisional areas, a single frame can be divided into first and second intervals each including 14 pulses of the data enable signal DE.

The common voltage control signal generator 226 can generate first and second common control signals based on the counted value applied from the line counter 222. The common voltage control signal generator 226 can generate the first common voltage control signal during the first interval in which the counted value increases from 1 to 14. The first common voltage control signal can be applied to the common voltage compensator 50. As such, the common voltage compensator 50 can generate the first compensated common voltage under the control of the first common voltage control signal and apply the first compensated common voltage to the first and second common electrode bars 101 and 103 of the liquid crystal display panel 10. In accordance therewith, the common electrode lines Vcom_n within the first divisional area A of the liquid crystal display panel 10 can receive the first compensated common voltage.

During the second interval in which the counted value increases from 15 to 28, the common voltage control signal generator 226 can generate the second common voltage control signal and apply the second common voltage control signal to the common voltage compensator 50. As such, the common voltage compensator 50 can generate the second compensated common voltage under the control of the second common voltage control signal and apply the second compensated common voltage to the first and second common electrode bars 101 and 103 of the liquid crystal display panel 10. Therefore, the common electrode lines Vcom_n within the second divisional area B of the liquid crystal display panel 10 can receive the second compensated common voltage.

Figure 7:
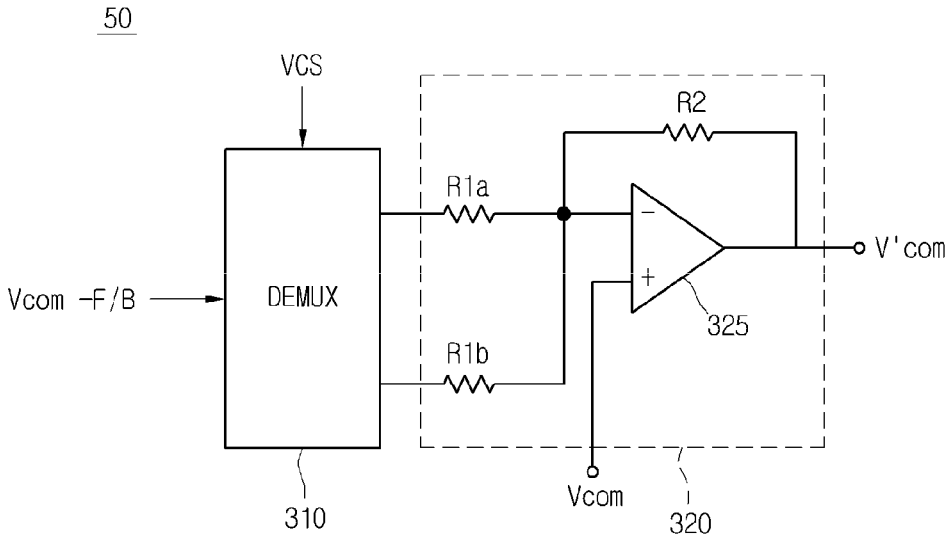
FIG. 7 is a circuit diagram showing an example of the common voltage compensator of FIG. 1.

FIG. 7 is a circuit diagram showing an example of the common voltage compensator of FIG. 1.

Referring to FIG. 7, the common voltage compensator 50 can include a demultiplexer 310 and an inverting amplifier 320.

The inverting amplifier 320 can generate the differently compensated common voltages in accordance with the common voltage control signals, which are generated in the intervals into which a single frame is defined under consideration of the number of divisional areas on the liquid crystal display panel 10, on the basis of the common voltage applied from the common voltage generator 45.

In other words, the inverting amplifier 320 can generate the compensated common voltage V' com by inversely amplifying the common voltage feedback signal Vcom-F/B which is fed back from at least one of the first and second common electrode bars 101 and 103 of the liquid crystal display panel 10, based on the common voltage Vcom applied from the common voltage generator 45.

As an example, the common voltage feedback signal Vcom-F/B can include ripple caused by the data voltage applied to the liquid crystal display panel 10, but it is not limited to this.

The ripple of the common voltage feedback signal Vcom-F/B is phase-inverted by being inverse-amplified with an inverse amplification ratio previously set in the inverting amplifier 320. The phase-inverted, amplified ripple is reflected into the common voltage Vcom, thereby generating the compensated common voltage V' com.

The ripple of the compensated common voltage V' com obtained using the inverse amplification ratio can have the same amplitude as that of the common voltage feedback signal Vcom-F/B and an inverted phase compared to that of the common voltage feedback signal Vcom-F/B, but it is not limited to these.

Such a compensated common voltage V' com is applied to the first and second common electrode bars 101 and 103. As such, the common voltage Vcom can be compensated for.

The inverting amplifier 320 can include a differential amplifier 325, at least one resistor R1*a*, R1*b* connected to an inverting terminal (−) of the differential amplifier 325, and a negative feedback resistor R2 connected between the inverting terminal and an output terminal of the differential amplifier 325.

Although it is not shown in the drawings, at least one capacitor together with the at least one input resistor can be serially connected to the inverting terminal (−) of the differential amplifier 325.

An input line can be connected to the non-inverting terminal (+) of the differential amplifier 325. The input line is used to receive the common voltage Vcom from the common voltage generator 45.

The at least one resistor can be connected to the demultiplexer 310 in parallel. Also, the at least one resistor can be commonly connected to the inverting terminal (−) of the differential amplifier 325.

The number of at least one resistor R1*a*, R1*b* can depend on the number of divisional areas which is set by the divisional area set portion 224 of the common voltage controller 220, but it is not limited to this.

For example, in order to divide the liquid crystal display panel 10 into the two divisional areas A and B as shown in FIG. 2, the parameter (the address signal) regarding to the two divisional areas A and B can be set by the divisional area set portion 224. In this case, the at least one resistor can include two resistors, i.e., the first and second resistors R1*a* and R1*b*.

As such, the inverse amplification ratio of the differential amplifier 325 can be set to be resistance ratio of the negative feedback resistor/the first resistor R2/R1*a*, or the resistance ratio of the negative feedback resistor/the second resistor R2/R1*b*. The resistance ratio of the negative feedback resistor/the first resistor R2/R1*a* can be a first inverse amplification ratio and the resistance ratio of the negative feedback resistor/the second resistor R2/R1*b* can be a second inverse amplification ratio.

As an example, a resistance value of the first resistor R1*a* can be set to be larger compared to a resistance value of the second resistor R1*b*. In this case, the second inverse amplification ratio can become larger than the first inverse amplification ratio.

For example, the first inverse amplification ratio R2/R1*a* can enable the ripple of the compensated common voltage V' com to have the same amplitude as that of the common voltage feedback signal Vcom-F/B (hereinafter, "first common voltage feedback signal") which is fed back from at least one of the first and second common electrode bars 101 and 103 of the liquid crystal display panel 10 during the first interval of a single frame, but it is not limited to this. The first common voltage feedback signal can include the ripple generated in the first divisional area A shown in FIG. 2. Such a ripple included in the first common voltage feedback signal can be offset by being amplified with the first inverse amplification ratio R2/R1*a* in the differential amplifier 325. In accordance therewith, the first compensated common voltage in which the ripple of the first common voltage feedback signal is offset can be generated.

As another example, the second inverse amplification ratio R2/R1*b* can allow the ripple of the compensated common voltage V' com to have the same amplitude as that of the common voltage feedback signal Vcom-F/B (hereinafter, "second common voltage feedback signal") which is fed back from at least one of the first and second common electrode bars 101 and 103 of the liquid crystal display panel 10 during the second interval of a single frame, but it is not limited to this. The second common voltage feedback signal can also include a ripple generated in the second divisional area B shown in FIG. 2. Such a ripple included in the second common voltage feedback signal can be offset by being amplified with the second inverse amplification ratio R2/R1*b* in the differential amplifier 325. Therefore, the second compensated common voltage in which the ripple of the second common voltage feedback signal is offset can be generated.

The demultiplexer 310 can serve the function of switching the common voltage feedback signal Vcom-F/B fed back from at least one of the first and second common electrode bars 101 and 103 to one of the first and second resistors R1*a* and R1*b* of the inverting amplifier 320 according to the common voltage control signal VCS applied from the common voltage controller 220, but it is not limited to this.

The demultiplexer 310 is disclosed in FIG. 7. However, instead of the demultiplexer 310, the present embodiment can include any element capable of switching the common voltage feedback signal Vcom-F/B fed back from at least one of the first and second common electrode bars 101 and 103 to one of the first and second resistors R1*a* and R1*b* of the inverting amplifier 320 according to the common voltage control signal VCS applied from the common voltage controller 220.

As an example, when the common voltage control signal is generated by the common voltage controller 20 during the first interval of a single frame, i.e., the first common voltage control signal is generated, the first common voltage control signal can enable the first common voltage feedback signal to be transferred to the first resistor R1*a* of the inverting amplifier 320. As such, the inverting amplifier 320 can generate the first compensated common voltage by inversely amplifying the first common voltage feedback signal with the first inverse amplification ratio of "the negative feedback resistor/the first resistor R2/R1*a*".

As another example, if the common voltage control signal is generated by the common voltage controller 20 during the second interval of a single frame, i.e., the second common voltage control signal is generated, the second common voltage control signal can allow the second common voltage feedback signal to be transferred to the second resistor R1*b* of the inverting amplifier 320. In accordance therewith, the inverting amplifier 320 can generate the second compensated common voltage by inversely amplifying the second common voltage feedback signal with the second inverse amplification ratio of "the negative feedback resistor/the second resistor R2/R1*b*".

The resistance values of the first and second resistors R1*a* and R1*b* can be set under consideration of the amplitude of the ripple included in the common voltage feedback signal Vcom-F/B which is generated in the first and second divisional areas A and B, but it is not limited to this.

FIG. 8 is a planar view showing the liquid crystal display panel of FIG. 1 which is divided into seven divisional areas.

As shown in FIG. 8, the liquid crystal display panel 10 is defined into seven divisional areas. Each of the divisional areas A through G can be driven in a time division mode during a single frame.

As such, a single frame can be divided into seven intervals, i.e., into first through seventh intervals. In this case, the first divisional area A can be driven in the first interval, the second divisional area B can be driven in the second interval, the third divisional area C can be driven in the third interval, the fourth divisional area D can be driven in the fourth interval, the fifth divisional area E can be driven in the fifth interval, the sixth divisional area F can be driven in the sixth interval, and the seven divisional area G can be driven in the seventh interval.

The term "drive" means serial processes of applying a gate signal to each gate line GLn, enabling each thin film transistor TFT connected to each gate line GLn to be turned-on by the gate signal, supplying the data voltage to the pixel electrode via the thin film transistor TFT, transferring the compensated common voltage V' com to each common electrode line Vcom_n in the pixel electrode, and displaying an image by a potential difference between the data voltage and the compensated voltage V' com.

The compensated common voltage V' com applied to the first and second common electrode bars 101 and 103 of the liquid crystal display panel 10 can be transferred to all the common electrode lines Vcom_n which are arranged within the first through seventh divisional areas A through G and connected to the first and second common electrode bars 101 and 103.

Nevertheless, the common voltage feedback signal Vcom-F/B fed back from at least one of the first and second common electrode bars 101 and 103 can include ripple caused by the data voltages which are applied to the respective divisional area of the liquid crystal display panel 10 during the respective interval of a single frame.

As an example, the ripple, i.e., a first ripple caused by the data voltages which are applied to the second divisional area B of the liquid crystal display panel 10 during the second interval of a single frame can be included in the common voltage feedback signal Vcom-F/B fedback from at least one of the first and second common electrode bars 101 and 103.

As another example, the ripple, i.e., a second ripple caused by the data voltages which are applied to the fifth divisional area E of the liquid crystal display panel 10 during the fifth interval of a single frame can be included in the common voltage feedback signal Vcom-F/B fedback from at least one of the first and second common electrode bars 101 and 103.

Also, the common voltage Vcom is delayed more and more as it goes from the second divisional area B to the fifth divisional area E. As such, the delayed common voltage is more affected by the data voltages. In accordance therewith, the second ripple must have amplitude larger than that of the first ripple.

If the compensation of the common voltage is performed in order to offset only the first ripple, the second ripple can still remain without being completely removed.

Due to this, the compensation of the common voltage being performed based on a fixed divisional area of the liquid crystal display panel 10 causes image quality problems, which include crosstalk and so on, in the other areas.

The present embodiment enables the compensation of the common voltage optimized according to each position of the liquid crystal display panel 10 to be performed. As such, image quality problems including crosstalk and so on can be prevented.

Figure 9:
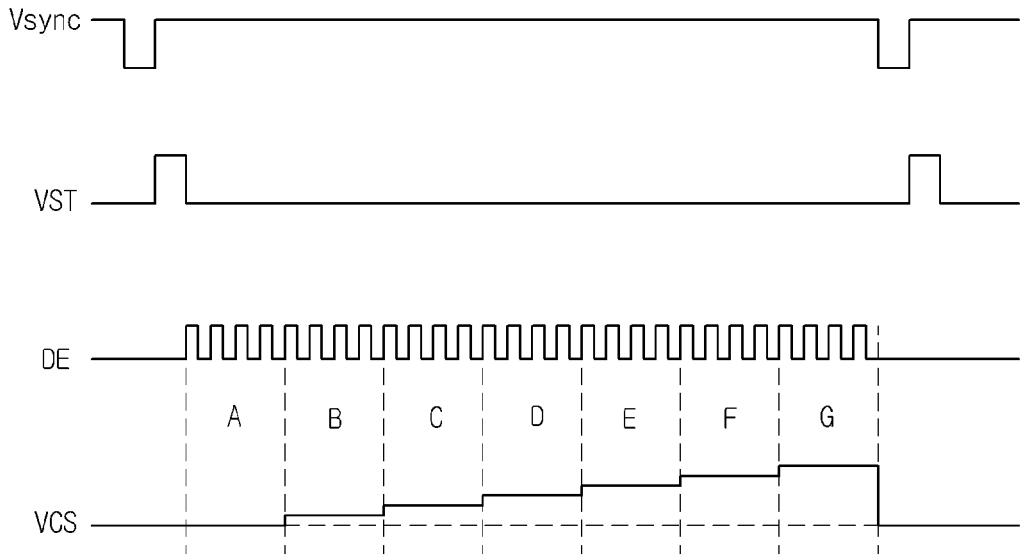
FIG. 9 is another waveform diagram illustrating input and output signals of the common voltage controller of FIG. 5.

In order to obtain a compensated common voltage V' com suitable for the seven divisional areas A through G divided as shown in FIG. 8, a signal waveform diagram such as FIG. 9 can be used.

Referring to FIGS. 5, 8 and 9, the common voltage control 220 can include a divisional area SETTING UNIT 224, a line counter 222 and a common voltage control signal generator 226.

The divisional area SETTING UNIT 224 can generate a parameter (an address signal) regarding the seven divisional areas A through G defined on the liquid crystal display panel 10.

The parameter (the address signal) regarding the seven divisional areas A through G can be applied from the divisional area SETTING UNIT 224 to the common voltage control signal generator 226.

The common voltage control signal generator 226 can divide a single frame into seven intervals, i.e., into first through seventh intervals on the basis of the parameter, which indicates the seven divisional areas A through G and applied from the divisional area SETTING UNIT 224. Also, the common voltage control signal generator 226 can generate the common voltage control signal VCS in each interval.

The line counter 222 can count the number of pulses included in the data enable signal DE. Also, the line counter 222 can supply the common voltage control signal generator 226 with the counted resultant value as a line count signal LCS.

The common voltage control signal generator 226 can divide the total number (for example, 28) of pulses of the data enable signal DE, which are included in the single frame, by the number (for example, 7) of divisional areas which is set by the divisional area SETTING UNIT 224, thereby calculating the number (for example, 4) of pulses of the data enable signal DE necessary for each interval.

The common voltage control signal generator 226 can generate the first common voltage control signal during the first interval in which the counted value increases from 1 to 4, using the line count signal LCS applied from the line counter 222.

Thereafter, the common voltage control signal generator can sequentially generate second and seventh common voltage control signals in the second through seventh intervals. The second common voltage control signal can be generated in the second interval in which the counted value increases from 5 to 8, the third common voltage control signal can be generated in the third interval in which the counted value increases from 9 to 12, the fourth common voltage control signal can be generated in the fourth interval in which the counted value increases from 13 to 16, the fifth common voltage control signal can be generated in the fifth interval in which the counted value increases from 17 to 20, the sixth common voltage control signal can be generated in the sixth interval in which the counted value increases from 21 to 24, and the seventh common voltage control signal can be generated in the seventh interval in which the counted value increases from 25 to 28.

The first through seventh common voltage control signals can be digital signals each having three bits.

For example, the first common voltage control signal can have a value of "000", the second common voltage control signal can have a value of "001", the third common voltage control signal can have a value of "010", the fourth common voltage control signal can have a value of "011", the fifth common voltage control signal can have a value of "100", the sixth common voltage control signal can have a value of "101", and the seventh common voltage control signal can have a value of "110". However, the present embodiment is not limited to this.

If the liquid crystal display panel 10 is defined into 16 divisional areas, 16 common voltage control signals with different logical values from one another are required. As such, the 16 common voltage control signals can be digital signals each having 4 bits.

Alternatively, when the liquid crystal display panel 10 is defined into the two divisional areas as shown in FIG. 2, two common voltage control signals with different logical values from each other are required. As such, the two common voltage control signals can be digital signals each having a single bit.

Figure 10:
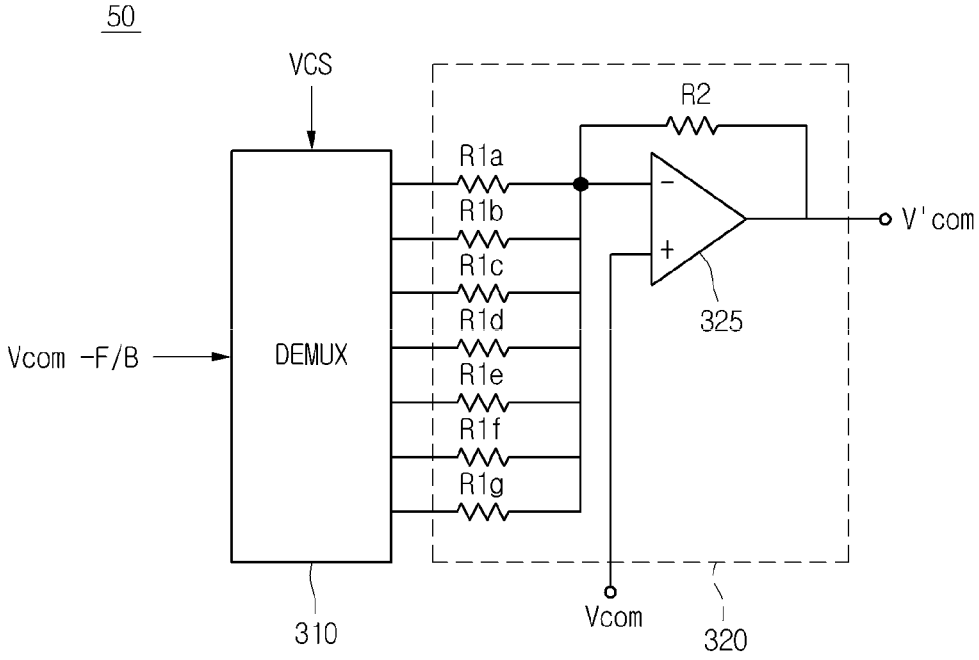
FIG. 10 is a circuit diagram showing another example of the common voltage compensator of FIG. 1.

FIG. 10 is a circuit diagram showing another example of the common voltage compensator of FIG. 1.

Referring to FIG. 10, the common voltage compensator 50 can include a demultiplexer 310 and an inverting amplifier 320.

The first through seventh common voltage control signals generated in a time division mode can be sequentially applied from the common voltage controller 220 of FIG. 5 to the common voltage compensator 50.

The common voltage compensator 50 can generate first through seventh compensated common voltages by inversely amplifying the common voltage feedback signal Vcom-F/B, which is fed back from at least one of the first and second common electrode bars 101 and 103 of the liquid crystal display panel 10, with inverse amplification ratios according to the first through seventh common voltage control signals.

The inverting amplifier 320 can include a differential amplifier 325, first through seventh resistors R1*a* through R1*g* connected to an inverting terminal (−) of the differential amplifier 325, and a negative feedback resistor R2 connected between the inverting terminal (−) and an output terminal of the differential amplifier 325.

The first through seventh resistors R1*a* through R1*g* can be connected to the demultiplexer 310 in parallel with one another. Also, the first through seventh resistors R1*a* through R1*g* can be commonly connected to the inverting terminal (−) of the differential amplifier 325.

Since such first through seventh resistors R1*a* through R1*g* are connected between the demultiplexer 310 and the inverting terminal (−) of the differential amplifier 325, the inverting amplifier 320 can have different inverse amplification ratios from one another. One of the first through seventh inverse amplification ratios can be selected as an inverse amplification ratio of the inverting amplifier 320 according to whether the common voltage feedback signal Vcom-F/B passing through the demultiplexer 310 is applied to any one of the lines connected to the first through seventh resistors R1*a* through R1*g*.

For example, the first inverse amplification ratio can be set to be "the negative feedback resistor/the first resistor R2/R1*a*", the second inverse amplification ratio can be set to be "the negative feedback resistor/the second resistor R2/R1*b*", the third inverse amplification ratio can be set to be "the negative feedback resistor/the third resistor R2/R1*c*", the fourth inverse amplification ratio can be set to be "the negative feedback resistor/the fourth resistor R2/R1*d*", the fifth inverse amplification ratio can be set to be "the negative feedback resistor/the fifth resistor R2/R1*e*", the sixth inverse amplification ratio can be set to be "the negative feedback resistor/the sixth resistor R2/R1*f*", and the seventh inverse amplification ratio can be set to be "the negative feedback resistor/the seventh resistor R2/R1*g*".

The resistance values of the first through seventh resistors R1*a* through R1*g* can be set under consideration of the amplitude of the ripple included in the common voltage feedback signal Vcom-F/B which is generated in the first through seventh divisional areas A through G, but it is not limited to this.

Meanwhile, an input line can be connected to the non-inverting terminal (+) of the differential amplifier 325. The input line is used to receive the common voltage Vcom from the common voltage generator 45.

The demultiplexer 310 can include first and second input terminals and first through seventh output terminals.

The first input terminal can be connected to a first input line used to receive the common voltage feedback signal Vcom-F/B which is fed back from at least one of the first and second common electrode bars 101 and 103 of the liquid crystal display panel 10. The second input terminal can be connected to a second input line used to receive the common voltage control signal VCS applied from the common voltage controller 220.

The first through seventh output terminals can be connected to the input lines of the first through seventh resistors R1*a* through R1*g* included in the inverting amplifier 320, respectively.

The demultiplexer 310 can switch-control the common voltage feedback signal Vcom-F/B fed back and received through the first input terminal to be applied to any one of the first through seventh output terminals which are connected to the input lines of the first through seventh resistors R1*a* through R1*g*, according to the common voltage control signal VCS applied from the common voltage controller 220.

As an example, if the demultiplexer 310 selects the second output terminal, the common voltage feedback signal Vcom-F/B received through the first input terminal can be transferred to the input line of the second resistor R1*b* connected to the second output terminal. Because the common voltage feedback signal Vcom-F/B is applied to the input line of the second resistor R1*b*, the second inverse amplification ratio of "the negative feedback resistor/the second resistor R2/R1*b*" is selected. As such, the differential amplifier 325 can inversely amplify the ripple of the common voltage feedback signal Vcom-F/B with the second inverse amplification ratio and reflect the inversely amplified resultant to the common voltage Vcom which is applied to a non-inverting terminal (+) of the differential amplifier 325. In accordance therewith, the second compensated common voltage can be generated.

Figure 11:
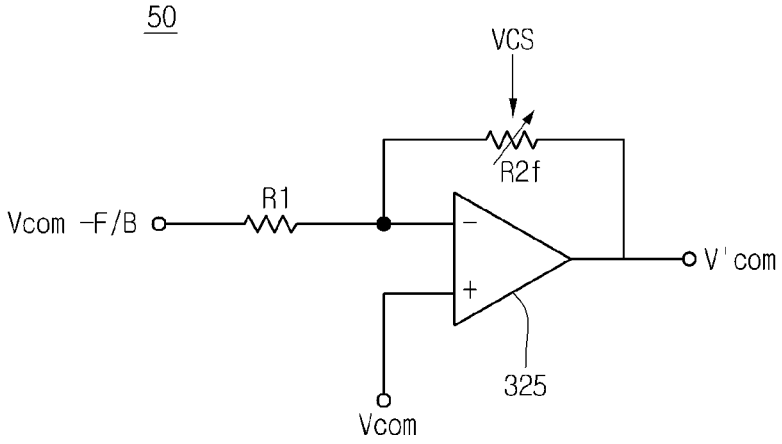
FIG. 11 is a circuit diagram showing still another example of the common voltage compensator of FIG. 1.

FIG. 11 is a circuit diagram showing still another example of the common voltage compensator of FIG. 1.

The common voltage compensator of FIG. 11 can be a modified example derived from those shown in FIGS. 7 and 10.

Referring to FIG. 11, the common voltage compensator 50 can include an inverting amplifier.

The common voltage compensator 50 can include a differential amplifier 325, a first resistor R1 connected to an inverting terminal (−) of the differential amplifier 325, and a second variable resistor R2*f* connected between the inverting terminal (−) and an output terminal of the differential amplifier 325.

The second variable resistor R2*f* is used as a negative feedback resistor. The resistance value of the second variable resistor R2*f* can vary along the common voltage control signal VCS applied from the common voltage controller 220, but it is not limited to this.

For example, the common voltage control signal generator 226 can divide a single frame into first and second intervals according to two divisional areas A and B of the liquid crystal display panel 10 which are set by the divisional area SETTING UNIT shown in FIG. 5. In this case, the second variable resistor R2*f* can have a first variable resistance value R' 2*f* by being varied along a first common voltage control signal generated in the common voltage control signal generator 226 during the first interval. As such, a first common voltage feedback signal being fed back from at least one of the first and second common electrode bars 101 and 103 of the liquid crystal display panel 10 can be inversely amplified with a first inverse amplification ratio of "R' 2*f*/R1". In accordance therewith, a first compensated common voltage that the inversely amplified resultant is reflected into the common voltage Vcom can be generated. The first common voltage feedback signal can be a signal including a ripple caused by the data voltages which are applied to the liquid crystal display panel 10 during the first interval.

On the other hand, the second variable resistor R2*f* can have a second variable resistance value R" 2*f* by being varied along a second common voltage control signal generated in the common voltage control signal generator 226 during the second interval. As such, a second common voltage feedback signal being fedback from at least one of the first and second common electrode bars 101 and 103 of the liquid crystal display panel 10 can be inversely amplified with a second inverse amplification ratio of "R" 2*f*/R1". In accordance therewith, a second compensated common voltage that the inversely amplified resultant is reflected into the common voltage Vcom can be generated. The second common voltage feedback signal can be a signal including a ripple caused by the data voltages which are applied to the liquid crystal display panel 10 during the second interval.

Figure 12A:
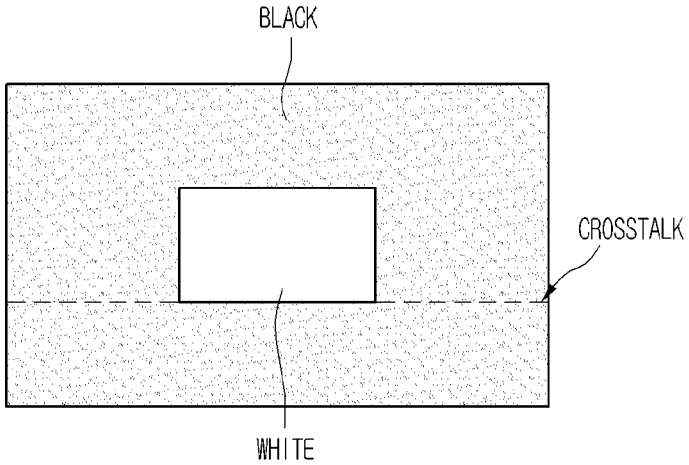
FIGS. 12A and 12B are planar views illustrating common voltage compensation schemes according to an embodiment of the present disclosure and the related art.
Figure 12B:
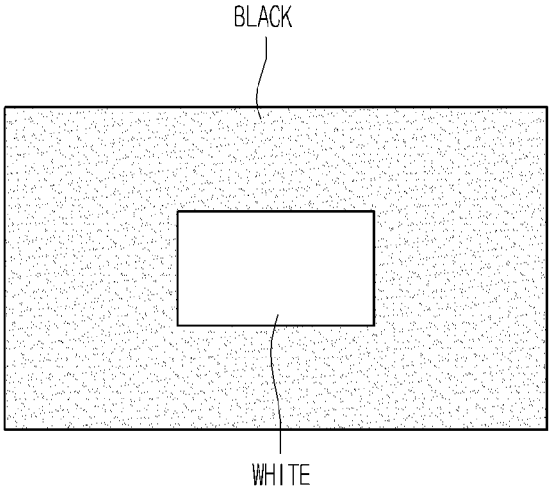

FIGS. 12A and 12B are planar views illustrating common voltage compensation schemes according to an embodiment of the present disclosure and the related art.

As shown in FIG. 12A, a white image can be displayed in a central area of the liquid crystal display panel and a black image can be displayed in a peripheral area surrounding the central area.

In this case, the compensation of a common voltage, which is suitable for an upper area of a horizontal normal line positioned at the center of the liquid crystal display panel, can be commonly performed for both the upper and lower areas of the liquid crystal display panel. Then, the common voltage can be optimally compensated in the upper area. As such, any image quality problem is not generated in the upper area of the liquid crystal display panel. However, the common voltage cannot be properly compensated in the lower area of the liquid crystal display panel. Due to this, image quality problems including crosstalk and so on are generated.

In other words, the image quality problems including crosstalk and so on are generated in the related art liquid crystal display panel.

Meanwhile, the present embodiment enables differently compensated common voltage from one another to be applied to positions of the liquid crystal display panel. For example, if the liquid crystal display panel is defined into a plurality of divisional areas, the present embodiment supplies the divisional areas with differently compensated common voltage from each another which are suitable to offset a ripple generated in each divisional area. In accordance therewith, image quality problems including crosstalk and so on are not generated in any area of the liquid crystal display panel, as shown in FIG. 12B.

Also, the present embodiment can generate differently compensated common voltages from one another, which will be applied to the divisional areas, according to the interval which is time-divided based on the gate start signal VST of the timing controller.

Moreover, the present embodiment can perform an optimized compensation of the common voltage suitable to prevent image quality problems including crosstalk and so on, through the simple modification of a circuit such as the number of output terminals of the demultiplexer, the number of resistors of the inverting amplifier and so on which are included in the common voltage compensator.

In this manner, the present embodiment divides a single frame into a plurality of intervals according to the number of divisional areas of the liquid crystal display panel previously set and supplies the liquid crystal display panel with differently compensated common voltages in the intervals. As such, the common voltage can be uniformly maintained throughout the liquid crystal display panel.

Also, the present embodiment offsets a ripple of the common voltage feedback signal fedback from the liquid crystal display panel according to the division areas of the liquid crystal display panel. In accordance therewith, the ripple included in the common voltage feedback signal can be completely removed. As a result, brightness problems can be prevented.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display device comprising:

a liquid crystal display panel configured to include at least one common electrode bar and a plurality of divisional areas perpendicular to the at least one common electrode bar, the plurality of divisional areas including a first divisional area and a second divisional area;

a common voltage compensator configured to generate a first compensated common voltage corresponding to the first divisional area, and a second compensated common voltage corresponding to the second divisional area, and apply the first compensated common voltage to the at least one common electrode bar of the liquid crystal display panel when the first divisional area is driven during a first portion of a single frame, and apply the second compensated common voltage to the at least one common electrode bar of the liquid crystal display panel when the second divisional area is driven during a second portion of the single frame, the common voltage compensator comprising:

an inverting amplifier having first inverse amplification ratio and second inverse amplification ratio and generating the first compensated common voltage and second compensated common voltage by inversely amplifying a common voltage feedback signal with the first inverse amplification ratio and second inverse amplification ratio, the common voltage feedback signal being fed back through the at least one common electrode bar of the liquid crystal display panel; and a demultiplexer configured to allow the common voltage feedback signal to be inversely amplified with one of the first inverse amplification ratio and second inverse amplification ratio, the demultiplexer comprising:

a first input terminal configured to receive the common voltage feedback signal, a second input terminal configured to receive a common voltage control signal, and a plurality of output terminals connected to a plurality of resistors of the inverting amplifier, respectively, wherein the common voltage feedback signal is output to one of the plurality of output terminals of the demultiplexer according to the common voltage control signal;

a common voltage controller for generating the common voltage control signal for controlling the common voltage compensator, the common voltage controller comprising:

a line counter configured to count pulses of a data enable signal based on the gate start signal to generate a line count signal; and a common voltage control signal generator configured to derive the common voltage control signal in each portion of the single frame from the number of pulses of the data enable signal;

wherein a number of portions of the single frame are obtained by dividing the number of pulses of the data enable signal into the number of divisional areas;

wherein the at least one common electrode bar has a first end electrically connected to an output terminal of the common voltage compensator and a second end electrically connected to an input terminal of the common voltage compensator; and wherein the second compensated common voltage applied during the second portion of the single frame to the second divisional area close to the second end of the at least one common electrode bar is greater than the first compensated common voltage applied during the first portion of the single frame to the first divisional area close to the first end of the at least one common electrode bar.

2. The liquid crystal display device of claim 1, further comprising:

a timing controller configured to generate control signals which are used to drive the liquid crystal display panel.

3. The liquid crystal display device of claim 2, wherein the control signals include a gate start signal used to indicate the start of a frame.

4. The liquid crystal display device of claim 1, further comprising:

a divisional area setting unit configured to provide a parameter indicative of the number of divisional areas which are defined on the liquid crystal display panel.

5. The liquid crystal display device of claim 1, wherein the inverting amplifier comprises:

a differential amplifier configured to inversely amplify the common voltage feedback signal;

the plurality of resistors connected to an inverting terminal (−) of the differential amplifier; and a negative feedback resistor connected between an output terminal of the differential amplifier and the inverting terminal of the differential amplifier.

6. The liquid crystal display device of claim 5, wherein each inverse amplification ratio is set to be a ratio of a resistance of the negative feedback resistor and a resistance of each corresponding one of the plurality of resistors.

7. The liquid crystal display device of claim 5, wherein the plurality of resistors each has a resistance value which is set by considering an amplitude of a ripple included in the common voltage feedback signal which is generated in the plurality of divisional areas of the liquid crystal display panel.

8. The liquid crystal display device of claim 1, wherein the respective divisional areas are driven according to a corresponding portion of the single frame.

9. The liquid crystal display device of claim 1, wherein when a specific divisional area is driven, the corresponding compensated common voltage is applied to the specific divisional area.

10. The liquid crystal display device of claim 1, wherein the second compensated common voltage is always greater than the first compensated common voltage.

* * * * *